United States Patent [19]

Richter

[11] 4,078,923

[45] Mar. 14, 1978

[54] MIGRATION IMAGING WITH SURFACTANT-MODIFIED SOLVENT DEVELOPMENT

[75] Inventor: Bela Richter, Rochester, N.Y.

[73] Assignee: Xerox Corporation, Stamford, Conn.

[21] Appl. No.: 775,507

[22] Filed: Mar. 8, 1977

[51] Int. Cl.[2] ..... G03Q 13/06; G03Q 13/22

[52] U.S. Cl. ..... 96/1 PS

[58] Field of Search ..... 96/1 PS, 1 M, 1 PE

[56] References Cited

U.S. PATENT DOCUMENTS

| | | | |
|---|---|---|---|
| 3,510,419 | 5/1970 | Carreira et al. | 96/1 PE |
| 3,820,984 | 6/1974 | Gundlach | 96/1 PS |
| 3,955,975 | 5/1976 | Kropac | 96/1 M |
| 3,975,175 | 8/1976 | Goffe | 96/1 PS |

*Primary Examiner*—Roland E. Martin, Jr.

[57] ABSTRACT

Solvent-developed negative charge-sensitized migration images exhibit visibly-reduced background when the developing solvent contains an effective amount of certain surface active agents.

2 Claims, No Drawings

MIGRATION IMAGING WITH SURFACTANT-MODIFIED SOLVENT DEVELOPMENT

BACKGROUND OF THE INVENTION

This invention relates to imaging systems employing a migration imaging member which includes a substantially conductive substrate, having contiguous one surface thereof a layer of substantially electrically insulating softenable material, the softenable layer containing a layer of migration material comprising selenium-containing particles spaced apart from the softenable layer-substrate interface, as more fully described in portions of U.S. Pat. No. 3,975,195, the entire disclosure of which I hereby expressly incorporate herein by reference.

In one of the methods of imaging such a system, the imaging member is charge-sensitized, exposed to a light and shadow image pattern, and then developed or softened by contact with a liquid or vaporous solvent for the softenable material, or by heat, as a result of which migration material imagewise migrates at least in depth in the softenable layer. The various imaging materials and image processing steps useful in this type of migration imaging are fully outlined in U.S. Pat. No. 3,975,195.

One of the preferred migration imaging members comprises a thin layer of particles containing selenium located at or near one surface of a softenable layer of substantially electrically insulating material, itself residing on a conductive substrate, such as aluminized Mylar. Although imaging is obtainable with such a member irrespective of the polarity of charge sensitization or the method of softening development, for positive polarity charging, best images are obtained (that is, lowest background) where development is by vapor or liquid softening and wash-away; for negative polarity charging, heat softening is generally employed for best results.

There are, however, several reasons for desiring liquid development of negatively-charged imaging members. First, liquid solvent development produces the best image contrast, since the background is completely removed by the solvent. However, with heat development, the background remains on the member and the image is read-out by the difference in color between the migrated areas and the unmigrated areas (red versus blue). Second, although it has been found that latent electrical images of both polarity types can be set and stored for extended periods of time, negative set images have the longest demonstrated shelf life, and can be set simply by storage in the dark; positive images, however, must be set by pre-softening with liquid solvent, an inconvenient procedure. Negative latent images can also be set by a gentle presoftening by heat short of development. In this context, the word "set" is defined to mean extended life against light, and/or life against time. A fuller description of this phenomenon is contained in any of copending applications, Ser. Nos. 349,505; 349,506; and 349,585; all filed Apr. 9, 1973. It is disclosed in those applications that negative-charge latent migration images, is presoftened by heat short of development, or if stored in the dark for more than about 200 minutes, become light proof and can be developed in the light without destruction of the latent image, and can be stored indefinitely. Third, for liquid development of migration images, a novel system has been invented for continuously and rapidly developing a strip of migration imaging film, as disclosed in U.S. Pat. No. 3,878,816, by passing the strip through a nip of developing fluid. Such a system possesses obvious advantages.

SUMMARY OF THE INVENTION

It would, therefore, be desirable to combine the advantages of liquid processing with the ability to easily set and store negative latent electrical migration images for future development, while maintaining lower image background than is normally found when liquid developing negatively-sensitized migration images.

This object has been achieved by developing a negatively-sensitized migration image with a solvent having incorporated therein an effective amount of a surfactant or mixture of surfactants selected from the group consisting of anionic salts of sulfated alcohols and alkylphenyl ethers of polyoxyethylene (hereinafter POE) glycols; cationic N-polyoxyethylated long-chain amines; non-ionic alkylethers of polyoxyethylene glycols; and non-ionic ethoxylated polyoxypropylene glycols. Migration images of good optical density have resulted, with substantial reduction of image background compared to that normally obtained when negative polarity migration images are liquid developed, whether the latent image is developed immediately after exposure, or some time after setting and storage.

DETAILED DESCRIPTION OF THE INVENTION

While it is not known for certain, it is theorized that the relatively high background generally produced when negatively-charged latent-imaged migration members are solvent-developed, is due to selenium-containing migration particles retaining applied negative charge in the unexposed areas to at least a small degree. Therefore, when a solvent is applied to the member, those "dark" particles with acquired charge will migrate along with the exposed particles, thus producing background. Apparently, the presence in a solvent of one of the above mentioned surfactants modifies the ability of the "dark" particles to retain or acquire applied charge, such that substantially fewer of them than normal will migrate in the background.

The imaging members useful in the process of this invention include the members described in U.S. Pat. No. 3,975,195, at least where the migration material comprises particles containing selenium. The softenable layer materials, substrate materials, developing solvents, and methods of member fabrication are fully outlined in that patent.

The surfactants to be combined with the developing solvents herein can be added in any amount which is effective in reducing the image background below that which is produced by using unmodified solvent. Although amounts of about 5 to 500 parts per million of surfactant to solvent were most commonly employed in the following work, there is no indication that this amount, or any other specific amount, is critical to this invention. In fact, it can be reasonably expected that greater or lesser amounts can be used depending on the precise solvents and softenable materials employed, and perhaps even upon the specific form which the selenium takes in the various types of migration particles which can be used. The critical discovery here is the observation that the surfactants of this invention can reduce background in solvent-developed, negatively-sensitized migration images.

Migration imaging members can be imaged by a variety of methods as explained in U.S. Pat. No. 3,975,195; however, the specific method with which this invention is useful, comprises applying a negative charge relatively uniformly across the free surface of the member (opposite the substrate), exposing the member to a light and shadow image pattern to form a latent image, optionally setting the latent image by storage in the dark for 200 minutes or more, or by gentle heating short of development, and developing the image by applying a solvent to the member to allow the exposed particles to migrate at least in depth in the softenable layer in image configuration. Ranges of charge voltages, light exposure intensities, and solvent contact times are given in U.S. Pat. No. 3,975,195.

The present invention, therefore, is illustrated in the following examples.

EXAMPLE 1

A migration imaging member is formed by the method of Example 3 in U.S. Pat. No. 3,975,195, and comprises a two-micron thick softenable layer of a custom-synthesized 80/20 mole percent copolymer of styrene and hexylmethacrylate, said layer residing on a three-mil thick substrate of aluminized mylar, the softenable layer having embedded in or near its upper surface (opposite the substrate) an approximately 0.3 micron thick layer of particulate vitreous selenium. The imaging member is corona-charged in the dark to a negative potential of about 60 volts. The member is then exposed to an optical image with an energy in the illuminated areas of about 5 f.c.s. The exposed member is then immersed in about 200 cc of 1,1,1-trichloroethane solvent for about 10 seconds. Inspection of the developed film in bright light reveals a dense, reddish image pattern corresponding to the light-struck portions of the film, surrounded, however, by heavy reddish background corresponding to the unexposed regions. Most of the plastic has been washed away by the solvent.

EXAMPLE 2

The process of Example 1 above was repeated, except that a surfactant, an anionic salt of sulfated alcohol, sodium sec-tetradecyl sulfate was added to the solvent, five parts to a million parts of the trichloroethane. This time, the developed film exhibited a dense, reddish well-formed image pattern in the light struck areas, while only a faintly visible reddish-orange haze remained in the background region. Image contrast density was, therefore, markedly improved using the surfactant-modified solvent.

EXAMPLE 3

The comparisons of Examples 1 and 2 were repeated, this time charging at 40 volts negative, and setting the latent image by storage of the exposed member in the dark for about 18 hours, and then developing with 1,1,1-trichloroethane without surfactant, and also with about 500 ppm of sodium sec-tetradecyl sulfate. The developed results without and with the surfactant were substantially the same as in respective Examples 1 and 2.

EXAMPLES 4–18

The process of Example 2 above was repeated, except that the following anionic salts of sulfated alcohols and alkylphenyl ethers of POE glycols were each separately employed as the modifying surfactant in the solvent: sodium n-octyl sulfate; sodium 2-ethylhexyl sulfate; sodium decyl sulfate; sodium lauryl sulfate; sodium cetyl sulfate; sodium sec-heptadecyl sulfate; sodium oleyl sulfate; sodium oleylstearyl sulfate; magnesium lauryl sulfate; ammonium lauryl sulfate; diethanolammonium lauryl sulfate; triethanolammonium lauryl sulfate; sodium salt of sulfated POE octylphenol; sodium salt of sulfated POE nonylphenol; ammonium salt of nonylphenyl ether of tetraethylene glycol.

In each case, migration images were obtained having visibly less background than those obtained in the Example 1 control.

EXAMPLES 19–47

The process of Example 2 above was repeated, except that the following cationic N-polyoxyethylated long-chain amines were each separately employed as the modifying surfactant in the solvent:

ethoxylated tertiary amines, tert.-$C_{12\text{-}14}H_{25\text{-}29}NH(C_2H_4O)_{1,5,15}H$;
POE stearyl amines (2,5,10,15,50EtO);
POE oleyl amines (2,5EtO);
ethoxylated tertiary amines, tert.-$C_{18\text{-}24}H_{37\text{-}49}NH(C_2H_4O)_{1,5,15,25}H$;
POE coco amines (2,5,10,15EtO);
POE tallow amines (2,5,15EtO);
POE soya amines (2,5,10,15,EtO);
POE rosin amine (5EtO);
N-B-hydroxyethyl stearyl imidazoline;
N-B-hydroxyethyl coco imidazoline;
N-B-hydroxyethyl oleyl imidazoline.

Again, in each case, migration images were obtained having visibly less background than those obtained in the Example 1 control.

EXAMPLES 48–66

The process of Example 2 above was repeated except that the following non-ionic alkyl ethers of POE glycols and ethoxylated polyoxypropylene glycols where each separately employed as the modifying surfactant in the solvent:

POE lauryl alcohol (4,23EtO);
POE trimethylnonyl alcohol (8EtO);
POE tridecyl alcohols (3,6,9,12,15EtO);
POE tetradecyl alcohol (7EtO);
POE stearyl alcohol (20EtO);
POE cetyl alcohol (20EtO);
POE oleyl alcohols (10,20EtO);
polyoxypropylene (M.W. 1200, 40%EtO);
polyoxypropylene (M.W. 1750,10%,20%,40%,80%,EtO);
polyoxypropylene (M.W. 2100,50%EtO).

Again, in each case, migration images were obtained having visibly less background than those obtained in the Example 1 control.

I claim:

1. An imaging process, which comprises sequentially:
   a. providing a migration imaging member which includes a substantially conductive substrate, having contiguous one surface thereof a layer of substantially electrically insulating softenable material, said softenable layer containing a layer of migration material comprising selenium-containing particles spaced apart from the softenable layer-substrate interface;

b. applying a negative charge to the surface of the softenable layer opposite the surface contiguous to the substrate;

c. exposing said charged surface to a light and shadow image pattern to form a latent electrical image;

d. applying to the softenable layer a solvent therefor, in order to allow imagewise migration of light-exposed migration material at least in depth in the softenable layer;

wherein said solvent contains an amount of a surfactant effective to decrease the amount of unexposed migration material which migrates when the surfactant is not present in the solvent;

the surfactant being a member or mixture of members selected from the group consisting of: anionic salts of sulfated alcohols; anionic salts of sulfated alkylphenyl ethers of polyoxyethylene glycols; cationic N-polyoxyethylated long-chain amines; non-ionic alkylethers of polyoxyethylene glycols; and non-ionic ethoxylated polyoxypropylene glycols.

2. The process of claim 1 further comprising, between steps (c) and (d) thereof, setting the electrical latent image.

* * * * *